US005240130A

United States Patent [19]

Osbakk

[11] Patent Number: 5,240,130

[45] Date of Patent: Aug. 31, 1993

[54] COMPRESSIBLE BOTTLE

[76] Inventor: Georg Osbakk, P.O. Box 42, N-8250 Rognan, Norway

[21] Appl. No.: 741,474

[22] PCT Filed: Jan. 26, 1990

[86] PCT No.: PCT/NO90/00019

§ 371 Date: Aug. 22, 1991

§ 102(e) Date: Aug. 22, 1991

[87] PCT Pub. No.: WO90/08698

PCT Pub. Date: Aug. 9, 1990

[30] Foreign Application Priority Data

Feb. 3, 1989 [NO] Norway ..... 890456

[51] Int. Cl.[5] ..... B65D 21/08; B65D 23/00; B65D 1/02; B65D 1/40

[52] U.S. Cl. ..... 215/12.1; 215/1 C; 220/636; 220/666; 220/907

[58] Field of Search ..... 215/1 C, 100 R, 12.1; 220/8, 666, 906, 672; 222/5, 104, 105, 107; 383/120

[56] References Cited

U.S. PATENT DOCUMENTS

| | | | |
|---|---|---|---|
| Re. 32,379 | 3/1987 | Touzani | 215/1 C |
| 1,835,581 | 12/1931 | Wolf | 222/105 |
| 2,886,084 | 5/1959 | Davison | 220/666 |
| 3,155,281 | 11/1964 | Stracey | 222/107 |
| 3,301,293 | 1/1967 | Santelli | 220/666 |
| 3,474,844 | 10/1969 | Lindstrom et al. | 220/666 |
| 3,557,788 | 1/1971 | Swartz | 220/666 X |
| 3,873,003 | 3/1975 | Seiferth et al. | 222/105 X |
| 4,456,134 | 6/1984 | Cooper | 215/1 C X |
| 4,930,644 | 6/1990 | Robbins, III | 220/8 X |
| 4,955,493 | 9/1990 | Touzani | 215/100 R |

FOREIGN PATENT DOCUMENTS

| | | | |
|---|---|---|---|
| 2504095 | 10/1982 | France | 220/66 |

*Primary Examiner*—Sue A. Weaver

*Attorney, Agent, or Firm*—Scully, Scott, Murphy & Presser

[57] ABSTRACT

A compressible body comprising a container and a flexible annular wall member, and the container, in turn, includes a cylindrical side wall and a prestressed locking member. The side wall of the container forms an upper edge and defines a cylindrical space having a given circumference, and the locking member of the container is mounted on the upper edge of the side wall and is inherently biased radially inwardly toward a position inward of that given circumference. The wall member of the bottle is mounted inside the container of the bottle, and that wall member has extended and compressed positions. In the extended position, the wall member extends upward from the container; and in the compressed position, the wall member is at least substantially contained within the container and the upper portion of the wall member is below the locking member of the container. Moreover, when the wall member is compressed into its compressed position, the locking member moves radially inwardly, due to is inherent resiliency, to a locking position in which the locking member extends directly over the upper portion of the wall member and locks that wall member inside the container.

2 Claims, 1 Drawing Sheet

COMPRESSIBLE BOTTLE

The present invention is related to a compressible bottle made of plastics.

BACKGROUND OF THE INVENTION

Increasingly different kinds of liquids are offered for sale in plastic bottle, which bottles are thrown away after use. Such empty bottles occupy large volumes previously filled with liquid. Even if some types of bottle materials are soft and as such easily compressed, the elasticity of the material brings the bottle back to its original shape, especially if the opening is not closed. Other types of material will resist any attempt of compression due to its stiffness.

SUMMARY OF THE INVENTION

With the compressible bottle according to the present invention there is provided a possibility for achieving a substantial reduction of the garbage volume in that an empty bottle according to the present invention can be easily compressed thereby only occupying a fraction of the original volume.

DETAILED DESCRIPTION OF THE PREFERRED EMBODIMENTS

Figure 1:
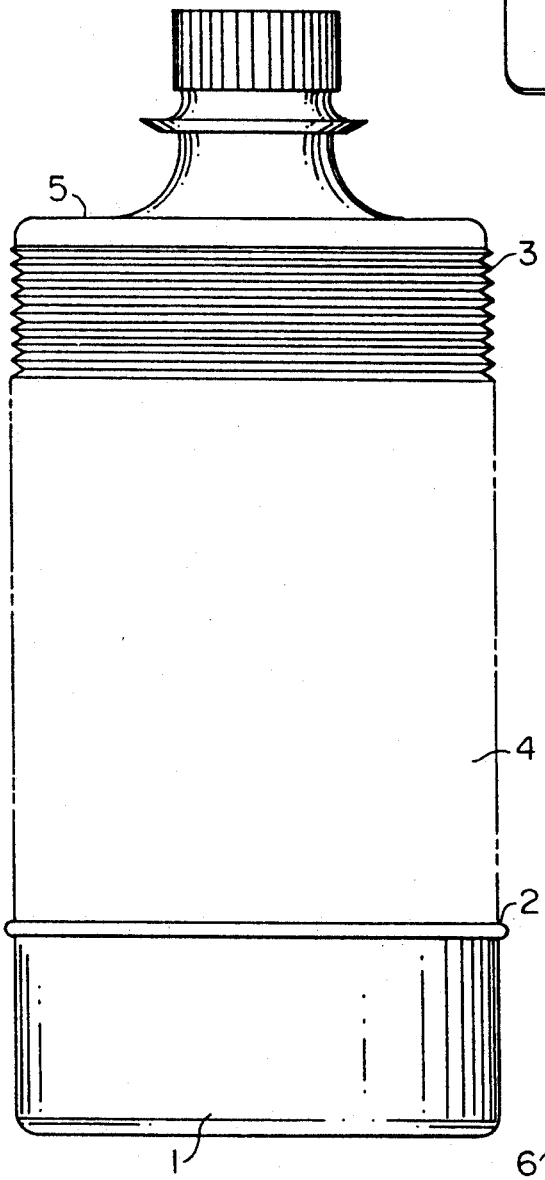
FIG. 1 discloses a side view of the bottle according to the present invention, FIG. 2 discloses a side view of the bottle after compression, FIG. 3 discloses a top view of the bottle after compression and FIG. 4 discloses an alternative embodiment in a vertical section and in two different positions.
Figure 2:
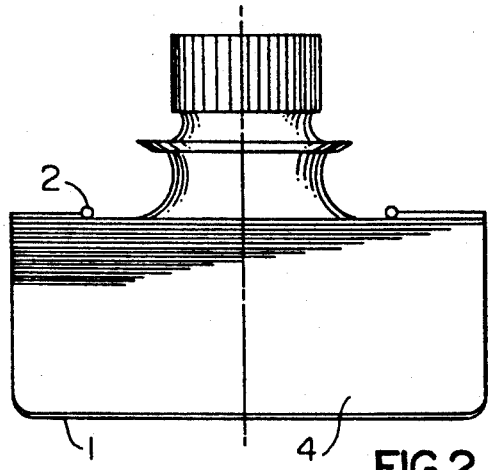
Figure 3:
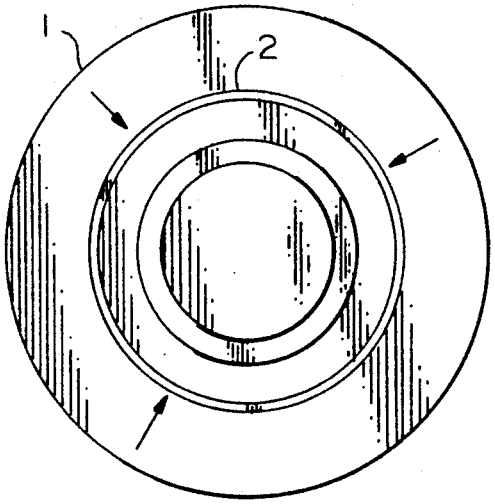

The compressible bottle according to the present invention comprises a container 1 having a height substantially corresponding to the height of the later compressed bottle. The upper edge of the container comprises a bead 2 being elastic and having an inherent prestressing. The bottle 4 itself has, along a substantial portion of its height, corrugations 3 or foldings with sharp edges corresponding to a bellow, in such a way that the bottle, without content, may be compressed to a fraction of its original height. Also, the bottle is arranged with the bottom of the bottle secured to the bottom of the container 1, inside the container and the cylindric portion folded in such a way that the bottle after emptying the content, can be compressed into the container 1. When the shoulder 5 of the bottle by compressing the bottle, passes by the elastic bead 2, the bead will contract from a diameter corresponding to the diameter of the container 1 and to a diameter where the bead 2 is arranged above the shoulder 5, thereby maintaining the compressed bottle in the container 1. The contraction of the bead 2 is schematically disclosed in FIG. 3.

With the compressible bottle according to the present invention, the empty, compressed bottle occupies only a minimum volume as compared to known compressed bottles and this volume will be maintained independently of whether the cover of the bottle is secured to the bottle neck or not.

The elastic bead 2 is produced continously with the container 1 and having a prestressing securing that the bead 2 contracts so much that it will protrude radially inwardly and above the shoulder 5 when the bottle is pressed into the container. As a modification of the above mentioned embodiment, the bead 2 may be secured to the edge of the container 1 until a locking device is removed, whereafter the bead contracts and thereby maintains the bottle in the container.

Figure 4:
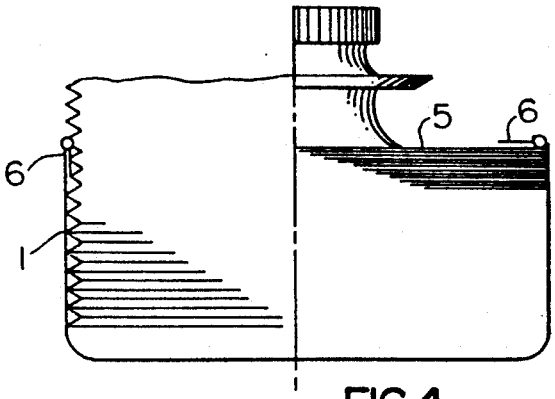

Another embodiment of the present invention is disclosed if FIG. 4 where the left half of the Figure discloses the bottle before compression and the right side discloses the bottle after compression. Replacing a surrounding bead, here at least two locking arms 6 are hinged to the upper edge of the container 1, being distributed along the circumference of the container. Preferably three or four locking arms are arranged. In the normal position of the bottle, the locking arms 6 are arranged on the inside of the container 1, parallel with the axis of the bottle and against the inner surface of the container 1. When the bottle is compressed and the shoulder 5 of the bottle thereby is pressed below the lower edges of the locking arms 6, the locking arms 6, due to their inherent prestressing quickly will be turned inwards and up and in this position abutting against a lock in the hinge arrangement of the locking arm thereby limiting the movement of the locking arm to approximately 90°. When the bottle thereafter is released, the shoulder of the bottle will abut against the locking arms 6, thereby maintaining the bottle compressed in the container.

I claim:

1. A compressible bottle comprising:

a container including i) a cylindrical side wall having an upper edge and defining a cylindrical shape having a given circumference, and ii) a prestressed locking means mounted on the upper edge of said side wall, extending generally along said given circumference, and being inherently biased radially inwardly toward a position inward of said given circumference; and a flexible annular wall member having i) a lower portion mounted inside the container side wall, and ii) an upper portion contiguous with and extending upward from the lower portion, the flexible annular wall member being compressible from i) an extended position in which the upper portion of the wall member extends upward from the container, to ii) a compressed position in which the upper portion of the wall member is below the locking means of the container;

wherein, when the wall member is compressed into the compressed position, the locking means moves radially inwardly, due to the inherent resiliency of the locking means, to a locking position in which the locking means is located inside the given circumference and extends directly over the upper portion of the flexible wall member and locks said flexible wall member inside the container.

2. A compressible bottle according to claim 1, wherein:

the locking means includes an elastic bead formed continuously with the side wall of the container, along the upper edge thereof; and said elastic bead is prestressed so that it contracts radially inwardly above said upper portion of the flexible wall member when said wall member is compressed into the compressed position.

* * * * *